US005109977A

United States Patent [19]

Mayer et al.

[11] Patent Number: 5,109,977

[45] Date of Patent: * May 5, 1992

[54] TAMPERPROOF COIN CASE

[75] Inventors: Stephen H. Mayer, El Toro; David Hall, Newport Beach, both of Calif.

[73] Assignee: Professional Coin Grading Service, Inc., Santa Ana, Calif.

[ * ] Notice: The portion of the term of this patent subsequent to Aug. 27, 2008 has been disclaimed.

[21] Appl. No.: 714,833

[22] Filed: Jun. 13, 1991

Related U.S. Application Data

[62] Division of Ser. No. 506,091, Apr. 9, 1990, Pat. No. 5,042,650.

[51] Int. Cl.[5] ..... B65D 85/58

[52] U.S. Cl. ..... 206/0.8; 206/0.84; 206/508; 206/512

[58] Field of Search ..... 206/0.8, 0.81, 0.82, 206/0.83, 0.84, 508, 509, 511, 512, 503

[56] References Cited

U.S. PATENT DOCUMENTS

| | | | |
|---|---|---|---|
| 3,145,833 | 8/1964 | Muller | 206/83 |
| 3,606,008 | 9/1971 | Lusetti | 206/84 |
| 4,691,824 | 9/1987 | Schindler | 206/509 X |
| 4,878,579 | 11/1989 | Hager | 206/84 |
| 4,915,214 | 4/1990 | Wieder | 206/82 |
| 4,979,619 | 12/1990 | Hager | 206/509 |
| 5,040,671 | 8/1991 | Hager | 206/509 X |
| 5,042,650 | 8/1991 | Mayer et al. | 206/512 X |
| 5,042,674 | 8/1991 | Ramsay et al. | 206/508 X |

*Primary Examiner*—Paul T. Sewell
*Assistant Examiner*—Jacob K. Ackun, Jr.
*Attorney, Agent, or Firm*—Bacon & Thomas

[57] ABSTRACT

A tamperproof coin case defined by two interlocking plastic plate members ultrasonically bonded together to define a unitary assembly within which a coin and its certificate of authenticity may be permanently secured. One plate member includes a cavity for fully receiving the other plate member therein, with opposing inner surfaces of the plate members being provided with corresponding cylindrical recesses which collectively form a cylindrical cavity within which a pliable plastic retention ring is disposed for securing the coin in a stationary position and permitting its obverse and reverse sides to be viewed through dome-shaped windows provided on the opposite sides of the case. The case is also provided with outwardly extending circumferential flanges which permit a plurality of cases to be vertically stacked for transport or storage.

1 Claim, 2 Drawing Sheets

FIG. 2
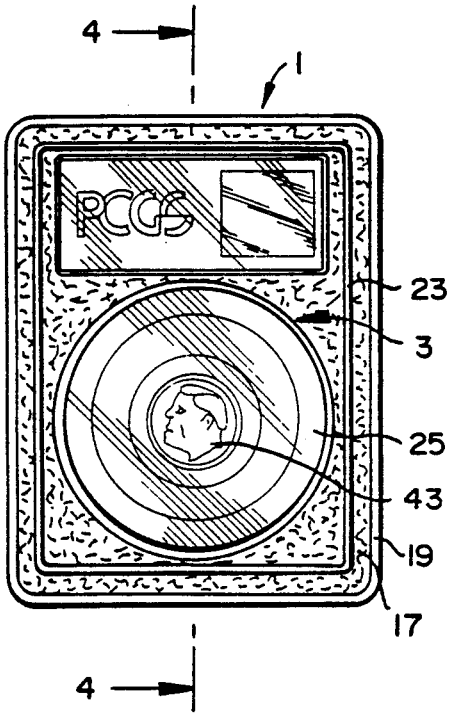
FIG. 3
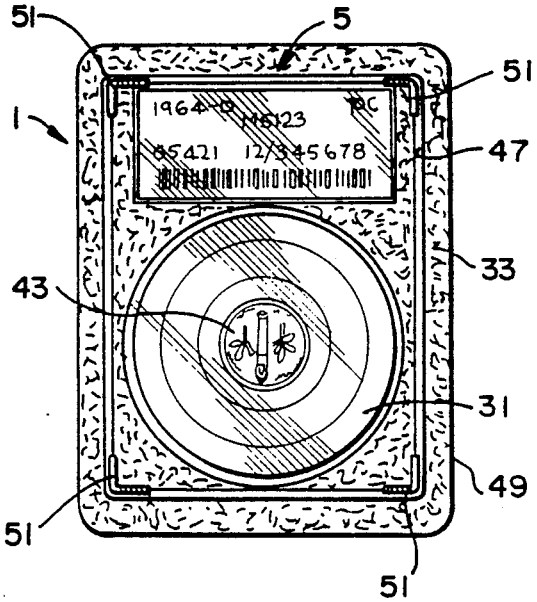
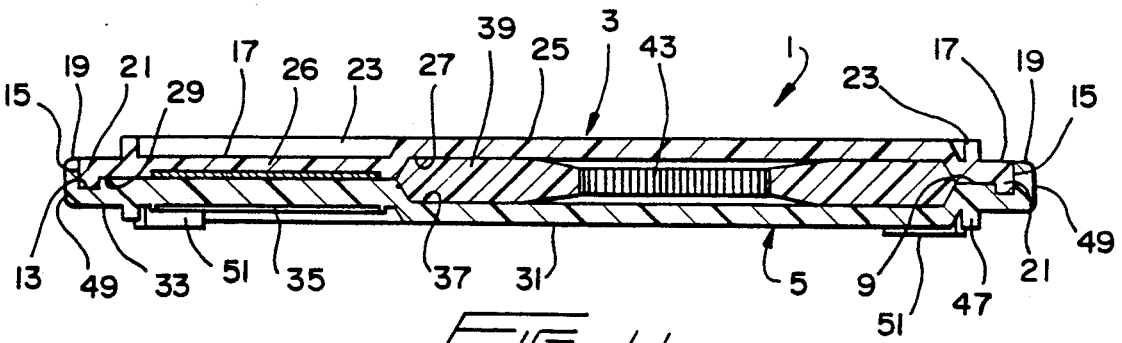
FIG. 4
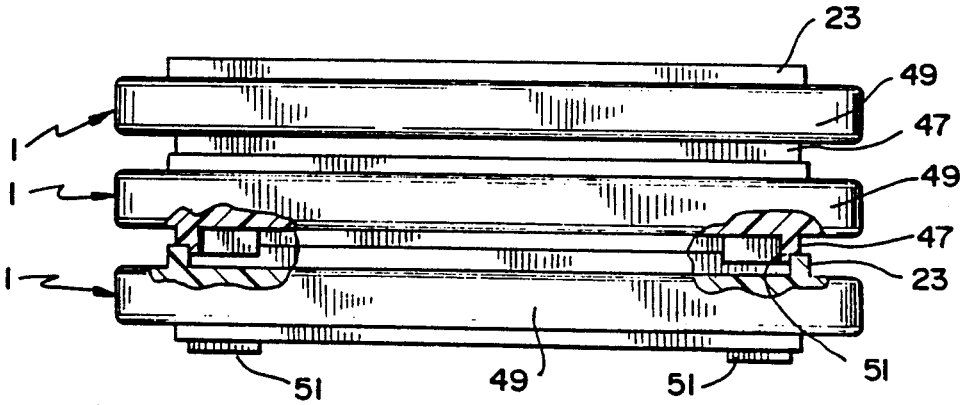
FIG. 5

TAMPERPROOF COIN CASE

This application is a division of application Ser. No. 07/506,091, filed Apr. 9, 1990, now U.S. Pat. No. 5,042,650.

BACKGROUND OF THE INVENTION

1. Field of the Invention

The present invention involves the field of technology pertaining to devices for storing and displaying valuable articles More particularly, the invention relates to an improved tamperproof case for storing and displaying a coin and its certificate of authenticity.

2. Description of the Prior Art

When valuable coins are sold or traded, it is often difficult for the purchaser to verify the authenticity and value of the coin being actually purchased. This is because it is easy for an unscrupulous seller to substitute a coin of lesser value for the original coin intended to be purchased.

The prior art has recognized this problem and provides for many different types of devices intended to prevent or provide evidence of unscrupulous practices in commercial coin transactions. These devices are generally in the form of a case formed from a pair of transparent plastic plates which sandwich the coin and its authentication certificate therebetween. The plates are then permanently secured together, such as by ultrasonically bonding interlocking edge portions of the plates. The bonded plates form a unitary assembly which is tamperproof and allows the purchaser to view both sides of the coin and determine its authenticity at the time of its purchase.

SUMMARY OF THE INVENTION

It is an object of the present invention to provide an improved tamperproof coin case.

It is another object of the invention to provide an improved case for displaying a coin and certifying its authenticity.

It is a further object of the invention to provide an improved coin case which is configured to permit plural cases to be stacked together for transport or storage.

These and other objects of the invention are realized by providing a coin case which is essentially defined by a pair of plastic plate members, with one plate member . having a cavity for receiving substantially the entire other plate member therein. The inner surfaces of the plate members are provided with corresponding cylindrical recesses for receiving a retention ring provided with a concentric aperture within which the coin is disposed. The outer side of each cylindrical recess defines a dome-shaped transparent window to permit viewing both obverse and reverse sides of the coin. Corresponding second window areas are formed in the plate members for receiving a certificate of authenticity which may be viewed from the exterior of the assembled case. The coin, retention ring and certificate are permanently sealed between the plate members by ultrasonically bonding interlocking edge portions of the plate members together after their assembly. The outer surfaces of the plate members are provided with correspondingly configured portions which permit the cases to be stacked together for transport or storage.

Other objects, features and advantages of the invention shall become apparent from the following detailed description of a preferred embodiment thereof, when considered in conjunction with the drawings wherein like reference characters refer to corresponding parts in the several views.

BRIEF DESCRIPTION OF THE DRAWINGS

FIG. 2 is a top plan view of the assembled case.

FIG. 3 is a bottom plan view of the assembled case.

FIG. 4 is a cross-sectional view of the assembled case taken along the line 4—4 of FIG. 2.

FIG. 5 is a side elevational view, partly in section, showing the manner in which a plurality of assembled cases are stacked together.

DETAILED DESCRIPTION OF THE PREFERRED EMBODIMENT

Figure 1:
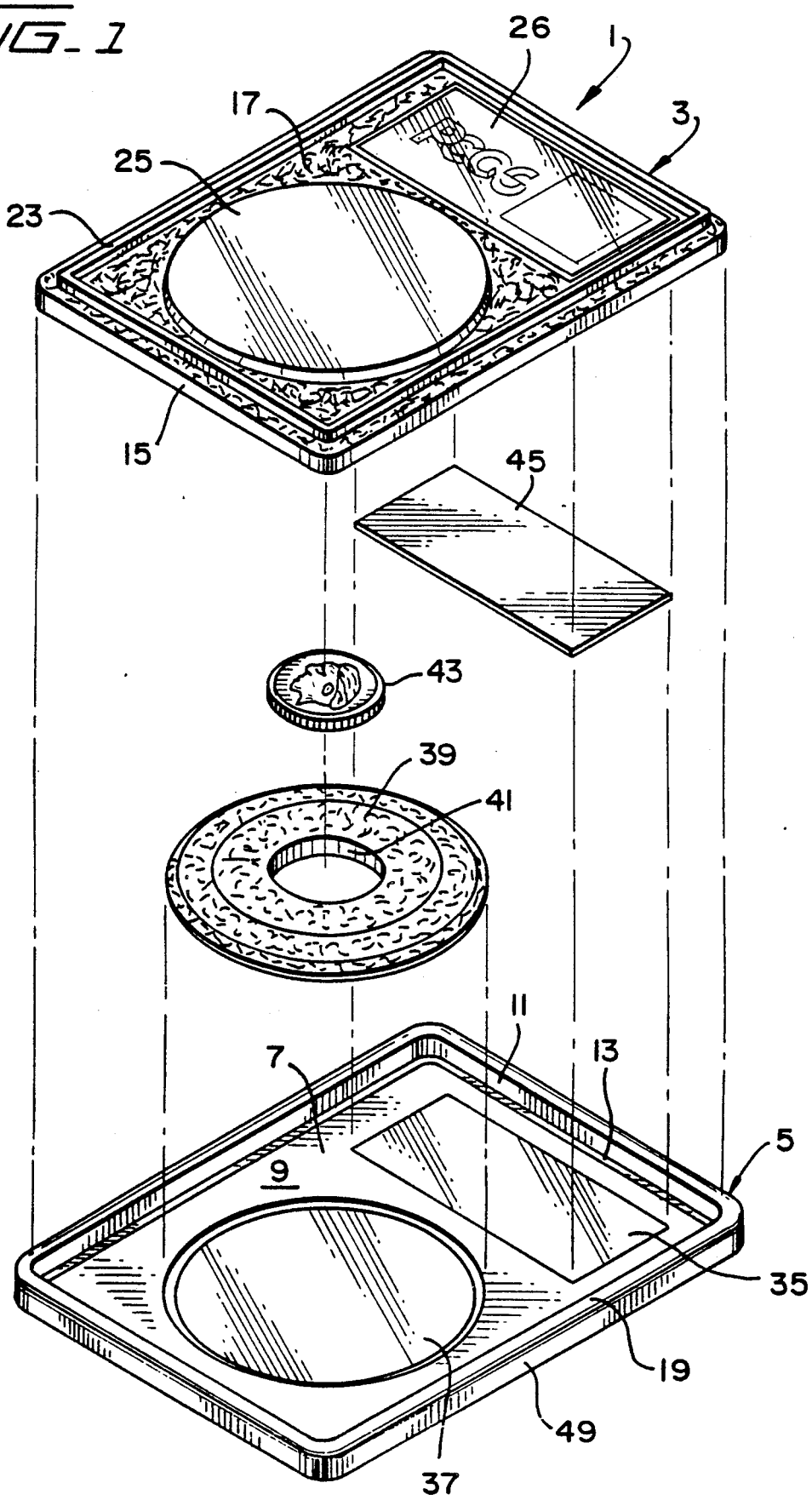
FIG. 1 is an exploded perspective view showing a tamperproof coin case according to a preferred embodiment of the invention.

A coin case 1 according to a preferred embodiment of the invention shall now be described with initial reference to FIGS. 1–4. As shown in FIG. 1, case 1 includes a first plate member 3 and a corresponding second plate member 5, each of which is of a substantially rectangular configuration. Plate member 5 includes a rectangular cavity 7 formed therein, with cavity 7 being defined by an inner surface 9 and an inner circumferential side wall 11. Cavity 7 also includes a circumferential groove 13 which extends around the junction between surface 9 and side wall 11. Plate member 3 includes an outer circumferential side wall 15, the width of which is substantially the same as the width of inner circumferential side wall 11 of plate member 5.

Plate member 3 is sized so as to be substantially fully receivable within cavity 7. An outer surface 17 of member 3 is disposed in substantially coplanar relationship with an upper peripheral edge surface 19 of plate member 5 when member 3 is positioned within cavity 7, as shown in FIG. 4. As also seen in FIG. 4, side wall 15 of plate member 3 partially defines a downwardly extending circumferential flange 21 which is received within groove 13 when member 3 is fully received within cavity 7, thereby defining an interlock engagement between adjacent edge portions of plate members 3 and 5.

Outer surface 17 of plate member 3 is provided with an outwardly extending circumferential flange 23 of rectangular configuration and spaced inwardly from side wall 15. Surface 17 is also provided with an outwardly extending transparent window 25, preferably dome-shaped, the height of which should be the same as or less than the height of peripheral flange 23. A second transparent window 26, preferably of rectangular configuration, is also provided in member 3. As seen in FIG. 4, the opposite side of window 25 defines a substantially cylindrical recess 27 formed in an inner surface 29 of plate member 3.

Similarly, plate member 5 includes a corresponding transparent dome-shaped window 31 extending outwardly from an outer side 33 thereof. There is also provided a second transparent window 35 of rectangular configuration corresponding to second window 26 of plate member 3. The opposite side of window 31 defines a corresponding cylindrical recess 37 in inner surface 9 of member 5. As seen in FIG. 4, when plate members 3 and 5 are assembled together, recesses 27 and 37 collectively define a cylindrical cavity within which a retention ring 39 may be snuggly disposed. Ring 39 includes a concentric aperture 41 which is sized to receive a desired coin 43 therein. Ring 39 serves to centrally locate and maintain coin 43 within the cylindrical cavity defined by recesses 27 and 37. This is shown in FIGS. 2 and 3 whereby assembled case 1 clearly displays both obverse and reverse sides of coin 43 through opposed windows 25 and 31, respectively.

As also seen in FIGS. 1–4, a certificate 45 may be disposed between plate members 3 and 5 in the vicinity of corresponding second windows 26 and 35. Certificate 45 is visible from both sides of assembled case 1 and serves to provide important information for authenticating coin 43 in terms of identification and description of quality. Moreover, certificate 45 may be of tamper resistant safety paper and provided with the trademark or logo of the coin supplier, a hologram, an internal covert tagging agent, bar code, photograph or any other information and means for providing authentication, certification, identification or accounting of coin 43. One or both of inner surfaces 9 and 29 may be provided with a recess in the vicinity of second windows 26 and 35 to locate and secure certificate 45 in a stationary position between plate members 3 and 5.

As particularly seen in FIGS. 3 and 4, outer side 33 of plate member 5 is also provided with an outwardly extending circumferential flange 47 corresponding to flange 23 of plate member 3. Flange 47 is also spaced inwardly from an outer circumferential side wall 49 of member 5 and corresponds substantially in configuration, location and size to flange 23. However, flange 47 also includes a right angle flange 51 positioned slightly inwardly of and extending outwardly from each corner portion thereof. Thus, when a plurality of assembled cases 1 are stacked vertically, as shown in FIG. 5, right angle flanges 51 of flange 47 are interlocked against the inner surfaces of the corresponding corner portions of flange 23, thus providing vertical alignment and preventing lateral movement of cases 1. A plurality of cases 1 may therefore be stacked together in this manner for transport or storage. The presence of flanges 23 and 47 prevent the outer surfaces of windows 25 and 31 from being accidently scratched or abraided during handling, particularly when the height of flanges 23 and 47 exceed the height of windows 25 and 31.

Plate members 3 and 5 are each preferably integrally formed from a high quality optical plastic material, such as polystyrene, in order to afford maximum transparency and clarity through dome-shaped windows 25, and second window areas 26 and 35. A preferred plastic material is Monsanto San 31 2060 357 Waterclear. Retention ring 39 is preferably formed from an inert pliable and clear plastic material, such as Dupont Elvax 250, so that coin 43 can be snuggly secured within aperture 41 and the rim portion of coin 43 can be viewed through ring 39.

After case 1 has been assembled in the manner shown in FIGS. 2–4, plate members 3 and 5 are then permanently secured together to form a unitary assembly. This is preferably achieved by ultrasonically bonding the interlocking edge portions of members 3 and 5 together to define a perimeter barrier which must be destroyed in order to gain access to coin 43 or certificate 45. Because of the manner in which plate member 3 is substantially fully received within cavity 7 of plate member 5 and the interlock engagement of flange 21 of member 3 within groove 13 of member 5, it shall become substantially impossible to tamper with the contents of case 1, after ultrasonic bonding has been effected, without affording evidence of such tampering. The procedure of ultrasonically bonding or welding plastic material is well known in the art and may be realized in any manner deemed appropriate for the practice of the invention as disclosed herein.

The invention therefore provides a novel and improved coin case which permanently encloses a coin and its certificate of authenticity in a secure and protective manner whereby any unauthorized removal of the coin or its certification, or tampering of the case, shall become immediately evident.

It is to be understood that the form of the invention herein shown and described is to be taken as a preferred embodiment thereof, and that various changes in shape, material, size and arrangement of parts may be resorted to without departing from the spirit or the invention or scope of the subjoined claims.

I claim:

1. A stackable tamper proof coin case comprising first and second plate members permanently joined together along abutting joint areas to provide a coin containment case, said plate members having generally flat first and second outer surfaces, and other circumferential side walls;

the outer surfaces of the first and second plate members including respective first and second engagement means to permit the stacking of plural assembled cases together with the flat outer surfaces spaced apart, said first engagement means comprising an outwardly extending continuous flange spaced inwardly of the outer circumferential side wall of the first plate member, and the second engagement means comprising an outwardly extending continuous flange spaced inwardly from the outer circumferential side wall of a second plate member said first and second flanges having substantially similar geometric configurations;

stacking flanges disposed adjacent limited areas only of said first engagement means and protruding outwardly beyond the outer surface of the first engagement means, said stacking flanges spaced inwardly from the outer edge of said first engagement means a distance sufficient to enable the second engagement means to be stacked in abutting relationship with said first engagement means without interference with the stacking flanges on the first engagement means;

whereby, when a pair of said cases identical to each other are stacked with the first engagement means of one case abutting the second engagement means of the other case, the stacking flanges of one case nest within the second engagement means of the other case.

* * * * *